United States Patent [19]

Burke

[11] Patent Number: 4,492,223

[45] Date of Patent: Jan. 8, 1985

[54] FLUID DISPENSING MASSAGE DEVICE

[75] Inventor: James E. Burke, Shelton, Conn.

[73] Assignee: Jack B. Hosid, Fairfield, Conn.

[21] Appl. No.: 393,683

[22] Filed: Jun. 30, 1982

[51] Int. Cl.[3] ..... A61H 15/00

[52] U.S. Cl. ..... 128/57; 401/190; 401/28; 128/67

[58] Field of Search ..... 128/57, 58, 54, 65–67; 215/247, 249; 401/208, 209, 134, 20, 190, 28; 222/402.13

[56] References Cited

U.S. PATENT DOCUMENTS

| | | | |
|---|---|---|---|
| 687,363 | 11/1901 | Wirt | 128/65 |
| 1,915,190 | 6/1933 | Koment | 128/54 |
| 2,584,735 | 2/1952 | Pancoast | 128/65 |
| 2,709,432 | 5/1955 | Ackerman | 128/57 |
| 3,032,803 | 5/1962 | Walshauser | 128/65 |
| 3,137,885 | 6/1964 | Hulsh | 401/190 |
| 3,305,144 | 2/1967 | Beres et al. | 401/190 |
| 3,606,555 | 9/1971 | Ferro | 401/190 |
| 3,612,706 | 10/1971 | Verga | 401/190 |
| 3,994,290 | 11/1976 | Springer et al. | 128/57 |

FOREIGN PATENT DOCUMENTS

| | | | |
|---|---|---|---|
| 40725 | 5/1916 | Sweden | 128/54 |

*Primary Examiner*—Richard J. Apley
*Assistant Examiner*—Harry Macey
*Attorney, Agent, or Firm*—Roland T. Bryan

[57] ABSTRACT

A hand held device that simultaneously massages and applies a beneficial fluid to the skin, the device being particularly adapted for facial applications. The device includes a handle assembly having separable upper and lower portions, and the upper portion has a bifurcated extension each branch of which supports a freely rotatable ball member. The two ball members are disposed relative to one another so that they coact in a desirable manner when engaging the area to be massaged. The lower portion of the handle assembly supports a replaceable cartridge containing fluid under pressure that is to be applied by the ball members. The cartridge is provided with a valve that permits metered amounts of the fluid to be dispensed from the cartridge and this fluid is carried by suitable conduits to an area on the surface of each ball member. A depressor accessible from the exterior of the massage device is positioned in the upper portion of the handle assembly for actuating the cartridge valve.

3 Claims, 6 Drawing Figures

FLUID DISPENSING MASSAGE DEVICE

RELATED APPLICATION

This application is related to application Ser. No. 309,435, now abandoned, filed Oct. 7, 1981 by Alan W. Brownlie and assigned to the assignee of the present application.

BACKGROUND OF THE INVENTION

This invention relates generally to personal care devices, and has particular reference to a novel hand held device for simultaneously massaging and delivering a beneficial fluid to the skin.

A number of devices have been developed heretofore for mechanically massaging the skin. Some of these devices, like the present invention, also provide for simultaneously applying a fluid or cream to the skin. However, none of the prior art devices known to the applicant employ a pair of coacting ball rolling members that are disposed with respect to one another as in the device to be disclosed herein, nor does the prior art teach the present invention's novel means for delivering fluid from a readily replaceable cartridge to the rolling members.

The closest prior art known to the applicant, developed in the course of a preliminary search, consists of U.S. Pat. Nos. 2,079,096; 2,103,261; 2,285,105; 2,706,474; 2,709,432; 3,542,016; 3,754,548 and 3,994,290.

SUMMARY OF THE INVENTION

The invention disclosed herein is directed to a hand held device that simultaneously massages and applies a beneficial fluid to the skin, the device being particularly adapted for facial applications but not restricted thereto. The device includes a handle assembly having separable upper and lower portions, and the upper portion has a bifurcated extension each branch of which supports a freely rotatable ball member. The two ball members are disposed relative to one another so that they coact in a desirable manner when engaging the area to be massaged.

The lower portion of the handle assembly is adapted to receive a replaceable cartridge containing the fluid that is to be applied by the ball members, the fluid being under pressure in the cartridge. The cartridge, in the embodiment disclosed, is provided with a valve that permits metered amounts of the fluid to be dispensed from the cartridge. The fluid that is dispensed is carried by suitable conduits to an area on the surface of each ball member. Means accessible from the exterior of the massage device are positioned in the upper portion of the handle assembly for actuating the cartridge valve.

DESCRIPTION OF THE PREFERRED EMBODIMENT

Figure 1:
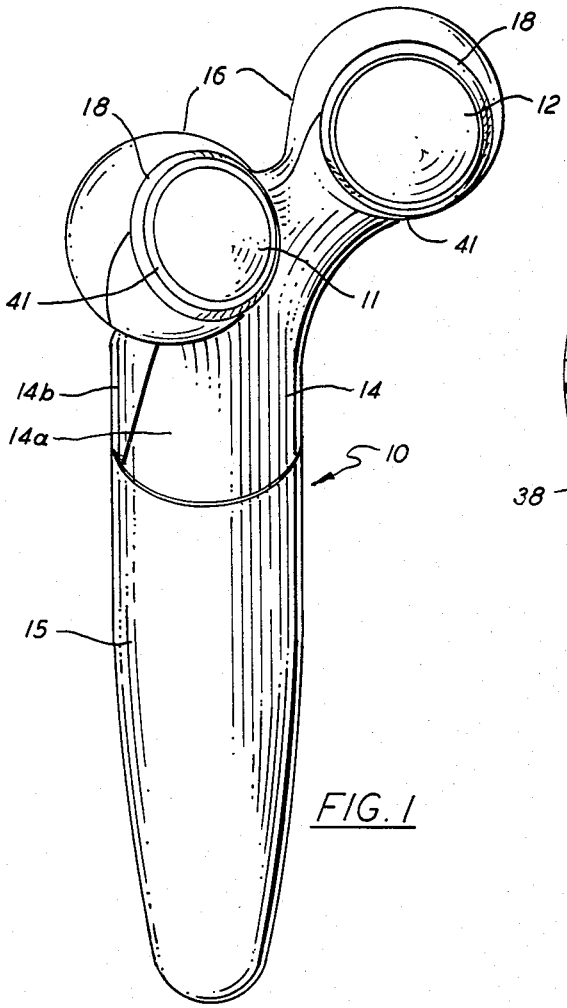
FIG. 1 is a front perspective view of a fluid dispensing massage device embodying the invention.

Having reference now to the drawings, and with particular reference to FIG. 1, the massage device is essentially comprised of a handle assembly generally indicated at 10 and a pair of free rolling ball members 11 and 12 which engage the area to be massaged and apply fluid thereto. Handle assembly 10 includes separable upper and lower portions 14 and 15, the upper portion having a bifurcated extension 16 the forks or branches of which respectively support the ball members 11 and 12. The extension 16 supports the ball members so that the spacing and angular disposition thereof enable them to coact in a most beneficial manner, and particularly when massaging angular areas such as the jawbone and chin. The handle assembly 10 contains a fluid cartridge and means for delivering fluid from the cartridge to the ball members 11 and 12 as will be presently described.

Figure 4:
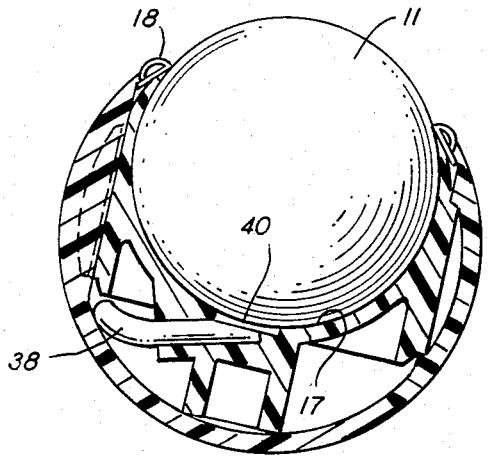
FIG. 4 is a transverse sectional view taken substantially on line 4—4 of FIG. 3.
Figure 2:
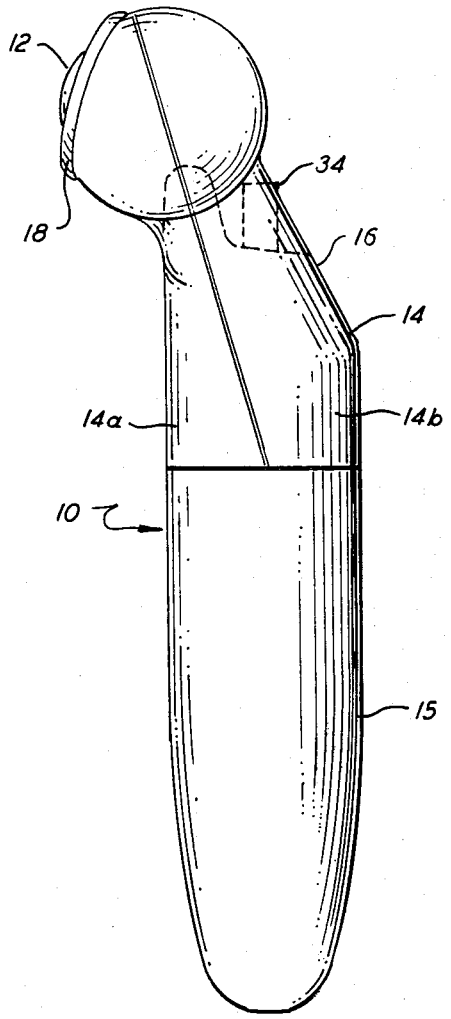
FIG. 2 is a side elevation of the device of FIG. 1.

The manner in which the ball members are supported in the handle extension 16 is the same for both and therefore only one need be described. Referring in particular to FIGS. 2 and 4, each branch of extension 16 is formed with a ball member receiving cavity 17 which coacts with a retaining ring or bezel 18 to maintain the member in the cavity. The ring 18 is secured in position on the extension branch after the ball member has been placed in the cavity.

The ball members 11 and 12 are smooth surfaced and are preferably made of a material such as poly-propylene. The balls are freely movable within the confines of their cavities whereby each can rotate about any of its infinite number of axes.

The upper portion 14 of the handle assembly 10 is comprised of two mating sections **14*a* and 14*b*, FIG. 2, which are permanently secured together during manufacture. The lower portion 15 of the handle assembly is a unitary tube-like receptacle that is releasably connected to the upper portion as by threads 24, FIG. 3**.

Figure 3:
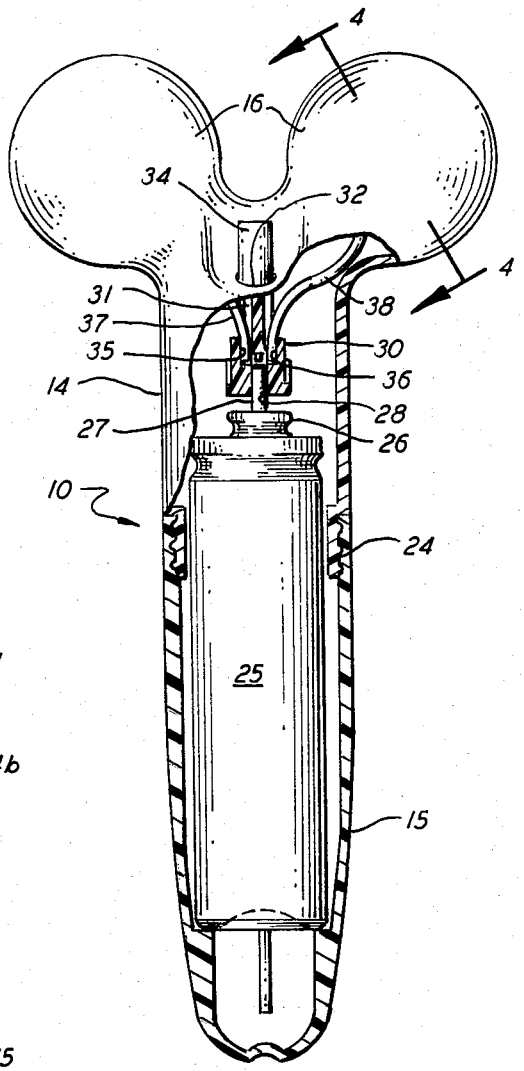
FIG. 3 is a rear elevation of the device with parts shown in section to illustrate the details of construction.

The lower handle portion is adapted to hold a cartridge 25, FIG. 3, which contains the fluid that is dispensed by the massage device, the fluid being under pressure in the cartridge. The cartridge is replaceable, and replacement can be accomplished by simply unthreading the lower handle portion and replacing a used cartridge with a new one. Cartridge 25 has a metered valve 26 of conventional construction at its upper end. The valve includes a reciprocable stem 27 that is normally spring biased into its outermost position. However, when the stem is depressed a metered amount of the fluid is dispensed through it.

The cartridge 25 projects above the lower handle portion 15, FIG. 3, so that it extends into the upper handle portion when the two portions are assembled. This causes the valve stem 27 to project up into a bore 28 in an actuator element 30, FIGS. 3, 5 and 6, positioned in the upper handle portion. The actuator element is mounted in the handle portion for reciprocable vertical movement as viewed in FIG. 3 and transmits this movement to the valve stem 27. The actuator is guided in this movement by suitable guide means (not shown).

Actuator 30 is formed with an upwardly projecting post 31 that extends up through an opening 32 in the upper portion 14 of the handle assembly, the top of the post being easily accessible to one using the massage device. As best seen in FIG. 3, the part of the post 31 that projects above the opening 32 is covered with a smooth cylindrical shell 34.

Figure 5:
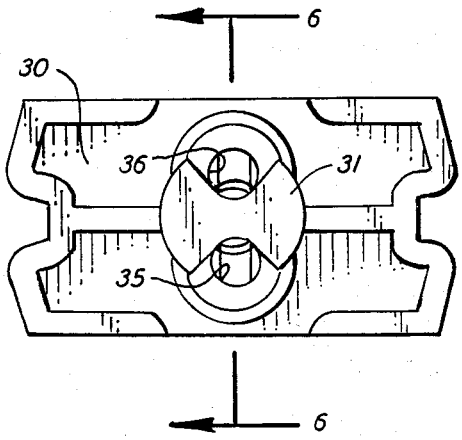
FIG. 5 is an enlarged top plan view of the actuator member.
Figure 6:
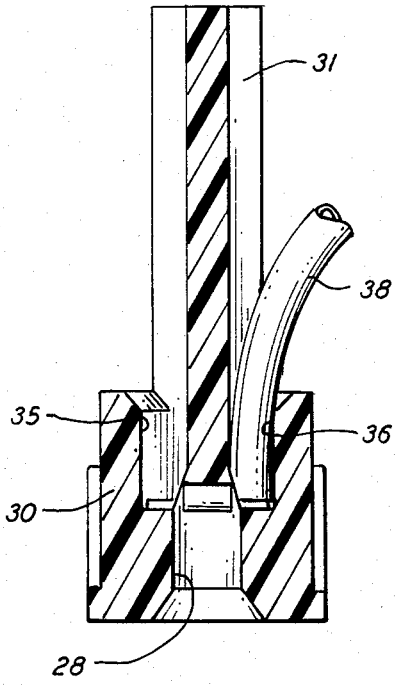
FIG. 6 is a vertical sectional view taken substantially on line 6—6 of FIG. 5, a portion of one of the fluid conduits being shown in operable engagement with the actuator member.

The bore 28 in the actuator 30 communicates with a pair of laterally offset bores 35 and 36, FIGS. 3, 5 and 7. The last-named bores are on opposite sides of the actuator post and are open at their upper ends. Positioned in the bores 35 and 36 with a press fit are a pair of flexible plastic tubes 37,38 which respectively extend up into the branches of extension 16. These tubes or conduits pass behind the ball members 11 and 12 and terminate in communication with shallow recesses 40, FIG. 4, in the back walls of the ball receiving cavities 17.

With this arrangement, whenever the shell 34, FIG. 3, is depressed it acts through the actuator 30 to depress the valve stem 27 whereby a metered amount of fluid under pressure is delivered to the tubes 37 and 38. The tubes in turn conduct the fluid to the recesses 40, and as the ball members rotate within their cavities due to their contact with the area being massaged they become coated with the fluid and thus apply it to that area. It should be noted in this connection that there is sufficient slack in the tubes 37 and 38 so that the actuator can be depressed without pulling the ends of the tubes out of the actuator bores 35,36 and without putting any strain on the tubes.

From the foregoing description it will be apparent that the invention provides a novel and very advantageous fluid dispensing massage device. As will be understood by those familiar with the art, the invention may be embodied in other specific forms without departing from the spirit or essential characteristics thereof.

I claim:

1. In a fluid dispensing massage device including a pair of rollable members adapted to engage the area to be massaged and a handle assembly having a bifurcated extension for supporting the rollable members, the handle assembly having separable upper and lower portions, the improvement comprising a replaceable cartridge containing fluid under pressure positioned in the lower portion of the handle assembly and extending upwardly therefrom into the upper portion, the cartridge including a metered valve that dispenses a metered amount of fluid from the cartridge when actuated, movable means in the upper portion of the handle assembly for actuating the metered valve, the valve extending upwardly into engagement with the movable actuating means, and a flexible tube extending from the actuating means to each rollable member for delivering fluid from the cartridge to the members, the tubes having sufficient slack to permit movement of the actuating means.

2. A device as defined in claim 1 wherein the valve actuating means includes an operating member that is accessible from the exterior of the massage device.

3. A device as defined in claim 1 wherein the valve includes a stem through which the fluid is dispensed, the stem being engaged by the valve actuating means.

* * * * *